US010036392B2

(12) United States Patent
Gallina

(10) Patent No.: US 10,036,392 B2
(45) Date of Patent: Jul. 31, 2018

(54) AXIAL FAN FOR INDUSTRIAL USE

(71) Applicant: Cofimco S.r.l., Pombia (IT)

(72) Inventor: Carlo Gallina, Cameri (IT)

(73) Assignee: COFIMCO S.R.L., Pombia (IT)

( * ) Notice: Subject to any disclaimer, the term of this patent is extended or adjusted under 35 U.S.C. 154(b) by 262 days.

(21) Appl. No.: 14/890,577

(22) PCT Filed: May 12, 2014

(86) PCT No.: PCT/IB2014/061381
§ 371 (c)(1),
(2) Date: Nov. 11, 2015

(87) PCT Pub. No.: WO2014/184727
PCT Pub. Date: Nov. 20, 2014

(65) Prior Publication Data

US 2016/0138601 A1 May 19, 2016

(30) Foreign Application Priority Data

May 14, 2013 (IT) ..... MI2013A0791

(51) Int. Cl.
*F04D 29/38* (2006.01)
*F04D 19/00* (2006.01)
*F04D 29/68* (2006.01)

(52) U.S. Cl.
CPC ..... *F04D 19/002* (2013.01); *F04D 29/384* (2013.01); *F04D 29/388* (2013.01); *F04D 29/681* (2013.01)

(58) Field of Classification Search
CPC .... F04D 19/002; F04D 29/384; F04D 29/388; F04D 29/681; F04D 25/088;
(Continued)

(56) References Cited

U.S. PATENT DOCUMENTS 634,885 A * 10/1899 Glover ..... F01D 5/145 416/231 R
1,779,026 A * 10/1930 Wragg ..... B64C 11/18 416/196 A (Continued)

FOREIGN PATENT DOCUMENTS

| | | | |
|---|---|---|---|
| CN | 202441648 | U | 9/2012 |
| EP | 2006488 | A2 | 12/2008 |
| FR | 951186 | A | 10/1949 |

OTHER PUBLICATIONS

International Search Report and Written Opinion dated Oct. 13, 2014 for Application No. PCT/IB2014/061381.

(Continued)

*Primary Examiner* — Eldon Brockman
(74) *Attorney, Agent, or Firm* — Patterson & Sheridan, L.L.P.

(57) ABSTRACT

An axial fan comprises a hub and a plurality of blades extending from the hub; wherein each blade comprises a main blade portion and a secondary blade portion and the secondary blade portion has a leading edge adjacent to a leading edge of the main blade portion and forms a flap for the main blade portion; wherein a fluid passage is defined between the leading edge of the main blade portion and the leading edge of the secondary blade portion; wherein the main blade portion has a main chord and the secondary blade portion has a secondary chord; and wherein the main chord and the secondary chord form a relative attack angle comprised between 5° and 35°.

14 Claims, 5 Drawing Sheets

(58) Field of Classification Search
CPC ..... F04D 29/324; F04D 29/38; F01D 5/146; F01D 5/141; F05D 2240/301
See application file for complete search history.

(56) References Cited

U.S. PATENT DOCUMENTS

| | | | | | |
|---|---|---|---|---|---|
| 2,003,073 | A * | 5/1935 | Faber | B64C 11/16 | 416/231 B |
| 2,045,383 | A * | 6/1936 | Faber | B63H 1/265 | 415/211.1 |
| 2,135,887 | A * | 11/1938 | Fairey | B64C 11/16 | 415/914 |
| 2,149,951 | A * | 3/1939 | Baker | B64C 11/16 | 416/231 B |
| 2,160,323 | A * | 5/1939 | Barnett | F01D 5/146 | 415/914 |
| 2,938,662 | A | 5/1960 | Bruno et al. | | |
| 3,075,743 | A | 1/1963 | Sheets | | |
| 3,195,807 | A * | 7/1965 | Sheets | F01D 5/141 | 415/199.4 |
| 4,102,600 | A * | 7/1978 | Schwab | F01D 5/145 | 416/231 R |
| 4,687,416 | A * | 8/1987 | Spranger | B64C 11/16 | 416/200 R |
| 6,206,635 | B1 * | 3/2001 | Golm | F04D 29/544 | 415/193 |
| 6,350,103 | B1 * | 2/2002 | Hashimoto | F01D 5/146 | 415/199.5 |
| 7,025,569 | B2 * | 4/2006 | Chang | F04D 29/38 | 416/183 |
| 7,281,900 | B2 * | 10/2007 | Zientek | B64C 27/467 | 416/231 B |
| 7,462,014 | B2 * | 12/2008 | Chang | F04D 29/38 | 415/193 |
| 8,573,941 | B2 * | 11/2013 | Hoeger | F01D 5/142 | 415/181 |
| 9,394,794 | B2 * | 7/2016 | Guemmer | F01D 5/145 | |
| 9,523,371 | B2 * | 12/2016 | Hollan | F04D 29/329 | |
| 2004/0062654 | A1 * | 4/2004 | Chang | F04D 29/38 | 416/223 R |
| 2007/0036651 | A1 * | 2/2007 | Lee | F04D 29/384 | 416/23 |
| 2008/0298974 | A1 * | 12/2008 | Guemmer | F04D 29/324 | 416/223 R |
| 2009/0151911 | A1 * | 6/2009 | De Filippis | F04D 29/384 | 165/122 |
| 2010/0303634 | A1 | 12/2010 | Long | | |
| 2011/0081246 | A1 * | 4/2011 | Aynsley | F04D 25/088 | 416/204 R |
| 2011/0318172 | A1 * | 12/2011 | Hoeger | F01D 5/142 | 415/181 |
| 2012/0148396 | A1 * | 6/2012 | Guemmer | F01D 5/145 | 415/208.2 |

OTHER PUBLICATIONS

Chinese Office Action dated Sep. 29, 2017, in Chinese Patent Application No. 201480028359.8.

* cited by examiner

AXIAL FAN FOR INDUSTRIAL USE

TECHNICAL FIELD

The present invention relates to an axial fan for industrial use.

BACKGROUND ART

As known, an axial fan generally comprises a hub and a plurality of blades which extend substantially in a radial direction from the hub.

The hub is rotatable about an axis and is connected to an electric motor for receiving a rotary motion by way of a transmission system.

The blades are provided with an airfoil, so that the rotation effect imparted by the motor, generates a pressure difference between the extrados and intrados of the blades. In turn, the pressure difference produces an air flow in a direction substantially parallel to the hub axis.

The air flow rate provided in axial motion depends on various factors, comprising mainly the rotation speed, the shape of the airfoil and the pitch angle of the blades.

It is known that, given a certain rotation speed, the incidence angle (i.e. the angle between the velocity vector of the air and the chord of the blade) is determined by the pitch angle and cannot exceed a critical threshold or stalling angle. In axial fans for industrial use, the pitch angle of the blades is normally between −4° and +30° (the pitch angle is usually measured using an inclinometer placed on the extrados of the blade at its distal end and oriented perpendicular to a radial direction).

Below the critical threshold, the air flow along the surface of the blades is laminar and allows to correctly exploit the curvature of the intrados and extrados of the blade to get lift. The turbulence is confined downstream from the reunification point of the flows lapping the extrados and the intrados, i.e. substantially downstream of the trailing edge of the blade.

If, instead, the incidence angle exceeds the critical threshold (stalling angle), the flows lapping the extrados and intrados fail to rejoin uniformly, are detached from the surface of the blade, and cause vortices downstream of the detachment point. The detachment takes place usually from peripheral areas of the blade, where the tangential speed is higher.

The vortices cause a loss of lift and, consequently, a decline of the fan efficiency. In practice, the flow rate set in motion does not increase or even decreases in response to a corresponding increment in the energy absorbed by the motor which drives the fan.

It is possible to design the blades of an axial fan so that the efficiency is greater for higher pitch angles of air and high speed, in part by limiting the risk of exceeding the critical threshold and trigger the formation of vortices. To this improvement, however, corresponds a reduced efficiency for pitch angles and/or lower speeds. Conversely, blades designed to have high efficiency at low pitch angles and at low speeds are totally unsatisfactory for higher angles and speeds, both for the low efficiency, and for greater ease to stall.

In axial fans for industrial use, in fact, the conditions of peripheral speed and pitch angles may vary in a substantial way. The axial fans for industrial use have normally, in fact, diameters ranging from about 1 m to about 12 m but the peripheral speeds can reach about 75 m/s. The pitch angles, instead, can vary in a range of about 30°-40°, as already noted. The working point may thus vary significantly and axial fans known are able to ensure sufficient efficiency only in a narrow range of operating conditions, contrary to what would be desirable. The difficulty of achieving satisfactory performance in a wider range of operating conditions is largely dependent on the separate peculiarities of axial fans for industrial use, particularly on the large size. A blade of said axial fans, in fact, measuring several meters in the radial direction, and therefore the speed difference between the distal end and the proximal end is very high, enough to bring the peripheral portions of the blades to stall conditions while the radially innermost portions still have a relatively abundant margin, but that cannot be exploited.

DISCLOSURE OF INVENTION

Purpose of the present invention is therefore to provide an axial fan which allows to overcome the limitations described above and, in particular, allows to obtain high efficiency over a wide range of pitch angles, incidence angles and peripheral speed of the blades.

According to the present invention, there is provided an axial fan comprising a hub and a plurality of blades extending from the hub; wherein each blade comprises a main blade portion and a secondary blade portion and the secondary blade portion has a leading edge adjacent to a trailing edge of the main blade portion and forms a flap for the main blade portion; and wherein between the trailing edge of the main blade portion and the leading edge of the secondary blade portion a fluid passage is defined.

According to a further aspect of the invention, the fluid passage is configured so as to allow the passage of a fluid flow from an intrados of the main blade portion to an extrados of the secondary blade portion.

The fluid passage thus created produces effects especially in the most critical portion of the blade, where the lapping flow tends to detach from the blade surface. The configuration of the blade is therefore particularly effective.

The secondary blade portion, which acts as a flap for the principal blade portion and defines the fluid passage, allows to improve the overall performance of the fan. In particular, the fluid passage is traversed by a fluid flow which causes a depression at the outlet of the fluid channel itself. In turn, the vacuum draws the lapping flow towards the blade surface and counteracts the detachment tendency which normally occurs over a speed threshold. The fan blades according to the invention may thus operate correctly even for speed and/or incidence angles that would cause stalling of blades of equal size, however, devoid of the fluid passage defined by the flap between intrados and extrados. The aerodynamic efficiency of the blade is at the same time improved by the general reduction of turbulence at the trailing edge.

BRIEF DESCRIPTION OF THE DRAWINGS

The present invention will now be described with reference to the accompanying drawings, which illustrate some examples of non-limiting embodiments, wherein.

BEST MODE FOR CARRYING OUT THE INVENTION

The invention described below is particularly suited for implementing axial fans of large dimensions, for example for heat exchangers used in plants for the liquefaction of natural gas, refineries or plants for the production of electricity in a combined cycle or with a steam turbine. In particular, the axial fans for industrial use have a diameter up to about 12 meters and rotation regimes that involve peripheral speeds of the blades up to about 75 m/s. Furthermore, for typical applications of axial industrial fans we must assume that the Reynolds number of the fluid processed, namely air, is greater than 10000.

Figure 1:
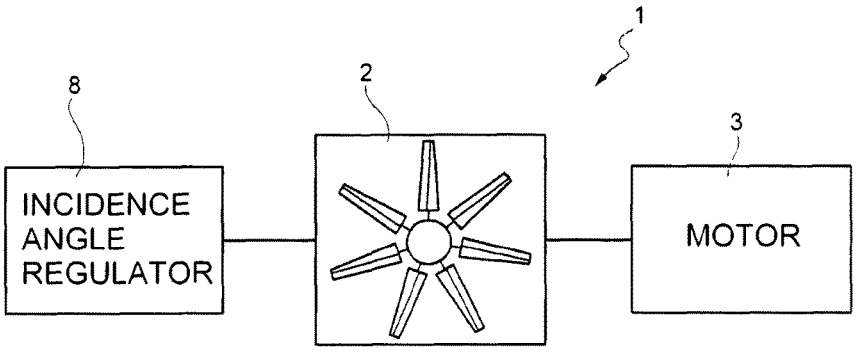
FIG. 1 is a simplified block diagram of an axial fan assembly according to a first embodiment of the present invention.

With reference to FIG. 1, a fan assembly, indicated in its entirety with the number 1, comprises an axial fan 2 driven by an electric motor 3.

Figure 2:
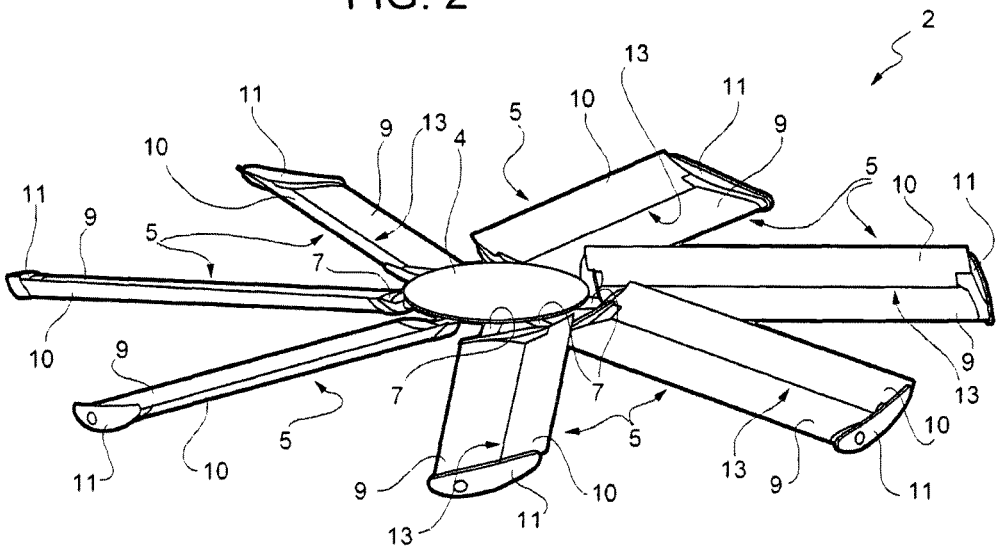
FIG. 2 is a perspective view of an axial fan of the fan assembly of FIG. 1.

The axial fan 2, which is represented in more detail in FIG. 2, comprises a hub 4, connected to a shaft of the electric motor 3, and a plurality of blades 5 which extend from the hub 4 substantially in the radial direction. The blades 5 may be made for example of aluminum, plastic or composite material reinforced with glass or carbon fibers. The blades 5 are also connected to the hub 4 by respective rods or bars 7. The bars 7 may be oriented about respective longitudinal axes for allowing to adjust a pitch angle of the blades 5 by a specific regulator 8 (FIG. 1).

Figure 3:
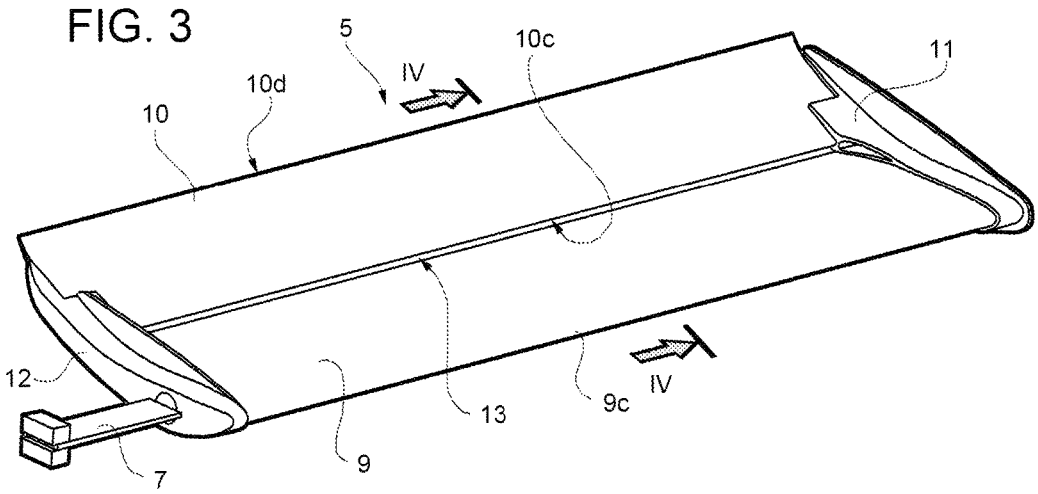
FIG. 3 is an enlarged perspective view of the blade of the axial fan of FIG. 2.
Figure 4:
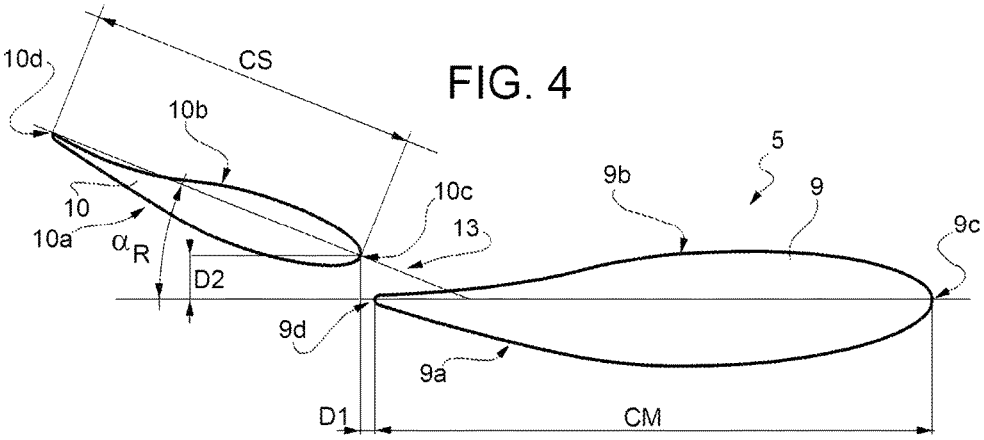
FIG. 4 is a side view of the blade of FIG. 3, sectioned along the trace plane IV-IV of FIG. 3.

As shown in FIGS. 3 and 4, each blade 5 comprises a main blade portion 9 and a secondary blade portion 10, both having an aerodynamic profile. The main blade portion 9 precedes the secondary blade portion 10 in the rotation direction of the blade 5.

In one embodiment, the aerodynamic surface of the main blade portion 9 is greater than the aerodynamic surface of the secondary blade portion 10 and provides a prevailing fraction of the aerodynamic loading. In a different embodiment the main blade portion 9 and the secondary blade portion 10 have equal aerodynamic surfaces.

The main blade portion 9 is rigidly fixed to the respective bars 7. Moreover, the main blade portion 9 and the secondary blade portion 10 are connected together at their respective ends by way of an outer end winglet 11 and by way of an inner end winglet 12. The outer end winglet 11 and inner end winglet 12 are arranged transverse to the main blade portion 9 and to the secondary blade portion 10 and extend tangentially with respect to the trajectory of the respective blade. The end winglets, especially the outer end winglet 11, allow to reduce the vorticity of the flow at the ends of the blade 5.

The main blade portion 9 has an extrados 9*a* and an intrados 9*b*, which are connected at the front along a leading edge 9*c* and in the back along a trailing edge 9*d*. A distance between the leading edge 9*c* and the trailing edge 9*d* defines a main chord CM of the main blade portion 9. The main blade portion 9 also has a main thickness, defined by a distance between the extrados 9*a* and the intrados 9*b* of the main blade portion 9 in the direction perpendicular to the main chord CM. The ratio between a maximum main thickness SMMAX and the main chord CM of the main blade portion 9, is preferably between 0.1 and 0.4.

The secondary blade portion 10 has an extrados 10*a* and an intrados 10*b*, which are connected at the front along a leading edge 10*c* and in the back along a trailing edge 10*d*. A distance between the leading edge 10*c* and the trailing edge 10*d* defines a secondary chord CS of the secondary blade portion 10. The secondary chord CS is less than the main chord CM or equal to it. For example, the ratio between the secondary chord CS and the main chord CM is comprised between 0.2 and 1. Moreover, the main chord CM and the secondary chord CS form a relative attack angle $\alpha R$ comprises between 5° and 35°.

The secondary blade portion 10 extends substantially parallel to the main blade portion 9 and forms a flap for the main blade portion 9 itself.

More precisely, the leading edge 10*c* of the secondary blade 10 is adjacent to the trailing edge 9*d* of the main blade portion 9 and spaced therefrom. In this way, between the trailing edge 9*d* of the main blade portion 9 and the leading edge 10*c* of the secondary blade portion 10 a fluid passage 13 is defined which allows the passage of a fluid flow from the intrados 9*b* of the main blade portion to the extrados 10*a* of the secondary blade portion 10. The fluid passage 13 is configured so that fluid flow through it is accelerated by Venturi effect.

The leading edge 10*c* of the secondary blade portion 10 and the trailing edge 9*d* of the main blade portion 9 are separated by a first interblade distance D1, in a direction parallel to the main chord CM, and by a second interblade distance D2, in the direction perpendicular to the main chord CM.

The ratio of the first interblade distance D1 to the main chord CM is less than or equal to 0.2. In the embodiment of FIG. 4, furthermore, the main blade portion 9 and the secondary blade portion 10 do not overlap in the direction of the main chord CM. Therefore, the leading edge 10*c* of the secondary blade portion 10 is arranged downstream of the trailing edge 9*d* of the main blade portion 9 in the direction of the main chord CM.

The ratio between the second interblade distance D2 and the main chord CM is less than or equal to 0.2.

Figure 5:
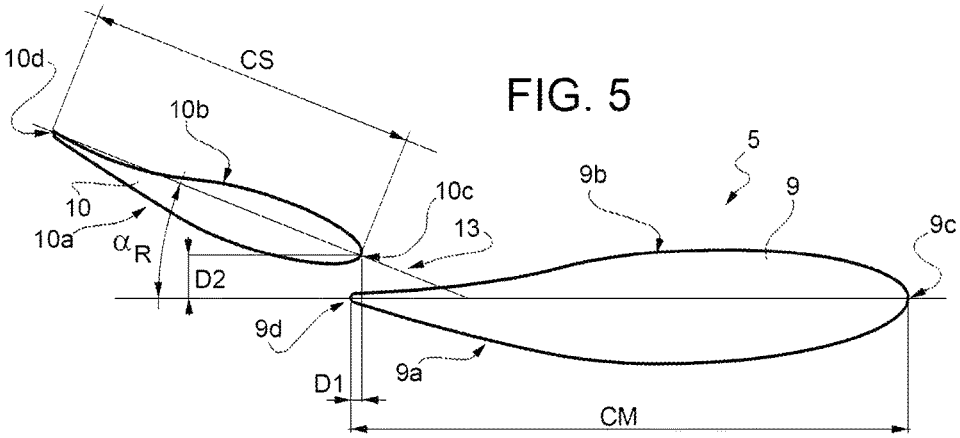
FIG. 5 is a sectional side view of a blade of an axial fan according to a second embodiment of the present invention.

In a different embodiment, illustrated in FIG. 5, the main blade portion 9 and the secondary blade portion 10 overlap in the direction of the main chord CM. Therefore, the leading edge 10*c* of the secondary blade portion 10 is arranged upstream of the trailing edge 9*d* of the main blade portion 9 in the direction of the main chord CM. The trailing edge 9*d* of the main blade portion 9 and the leading edge 10*c* of the secondary blade portion 10 are separated by a first interblade distance D1' in the direction of the main chord CM. Even in this case, the ratio between the first interblade distance D1' and the main chord CM is less than or equal to 0.2.

As mentioned, the secondary blade portion 10 acts as a flap for the blade portion 9 and the main fluid passage 13 allows the passage of a fraction of the flow lapping the blade 5 from the intrados 9*b* of the main blade portion 9 to the extrados 10*a* of the secondary blade portion 10. Moreover, the fluid flow passing through the fluid passage 13, which defines a bottleneck, is accelerated by Venturi effect. The increase in speed results in a decrease of pressure, which tends to draw the flow lapping the extrados 9*a* of the main blade portion 9 towards the extrados 10*a* of the secondary blade portion 10. Advantageously, the draw counteracts the detachment of the flow from the extrados 10*a* of the secondary blade portion 10 and the tendency of the blade 5 to stall. In practice, the blade 5 can be used with incidence angles higher with respect to a blade of the same size with continuous aerodynamic surface (i.e. devoid of the fluid passage). The aerodynamic efficiency of the blade is at the same time improved by the general turbulence reduction at the trailing edge.

Complex fluid dynamic simulations and subsequent campaigns of experimental tests in the wind tunnel have led to select ranges of values described for the main parameters of the blades 5, in particular for: the relative attack angle αR between the main chord CM and the secondary chord CS; the ratio between the first interblade distance D1 and the main chord CM; the ratio between the second interblade distance D2 and the main chord CM; the ratio between the secondary chord CS and the main chord CM; the ratio between the main maximum thickness SMMAX and the main chord CM of the main blade portion. It was possible to get blades 5 able to ensure high performance and efficiency on a wide variety of operating conditions. In particular, it was observed that the greatest benefits are given, in order, by the relative attack angle αR and by the values of the first interblade distance D1 and by the second interblade distance D2 in relation to the main chord CM.

Furthermore, it was found that the values of the selected parameters are advantageous especially with the surface materials and finishing (in terms of roughness) most common in the manufacture of axial fans blades for industrial use, such as extruded aluminum or made from bent metal sheet, with or without coating; pultruded composites or molding materials, with or without coating; extruded or molding plastic, with or without coating.

As is apparent from the charts of FIGS. 6-9, the use of blades 5 in an axial fan allows to get better performance than that with blades of equal size and uninterrupted aerodynamic surface virtually in all working conditions. The curves shown by the continuous line refers to the axial fan 2 provided with blades 5, while the dashed and dotted lines are related to a known axial fan with similar characteristics (size and number of the blades), but with the blades devoid of the fluid passage and flap.

Figure 6:
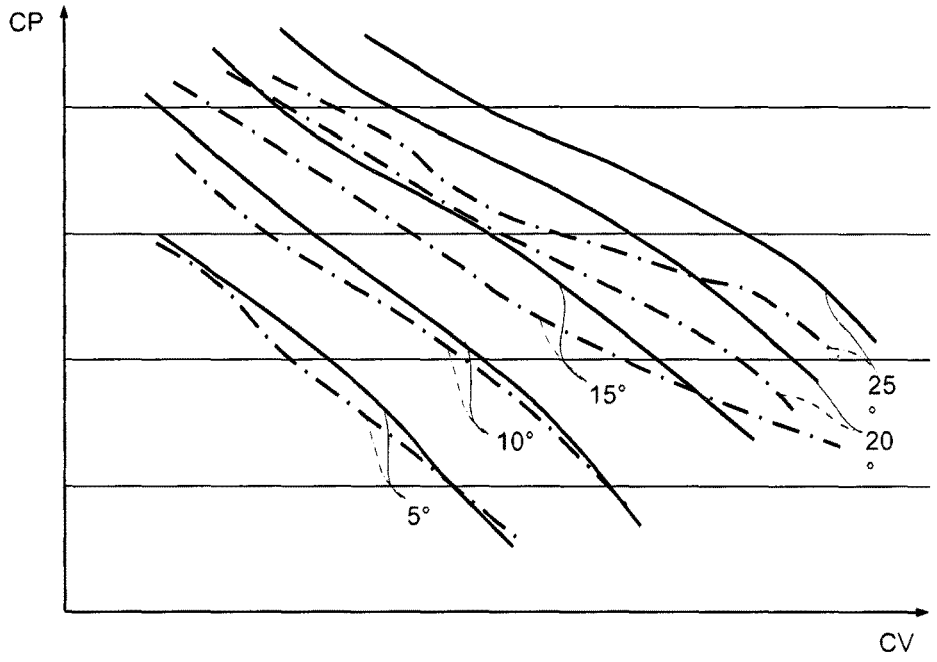
FIGS. 6-9 are graphs showing quantities relating to the fan of FIG. 1, in comparison to a known fan.

In particular, the graph of FIG. 6 shows the ratio between volumetric coefficient CV and pressure coefficient CP in the two cases, for different attack angles. The volumetric coefficient CV and the pressure coefficient CP are defined as follows:

$$CP = \frac{Q}{rpm * \varphi^3 \sqrt{S}}$$

$$CV = \frac{SP}{\rho * rpm^2 * \varphi^2 * S}$$

where $$S = \frac{C_{EQ} N_B}{\varphi}$$

is the solidity, CEQ is the equivalent chord (defined by the ratio between the surface and the blade length), NB is the number of the blades, Q is the flow rate of blown air, rpm is the angular speed, φ is the diameter of the axial fan, SP is the static pressure and ρ is the air density.

Figure 7:
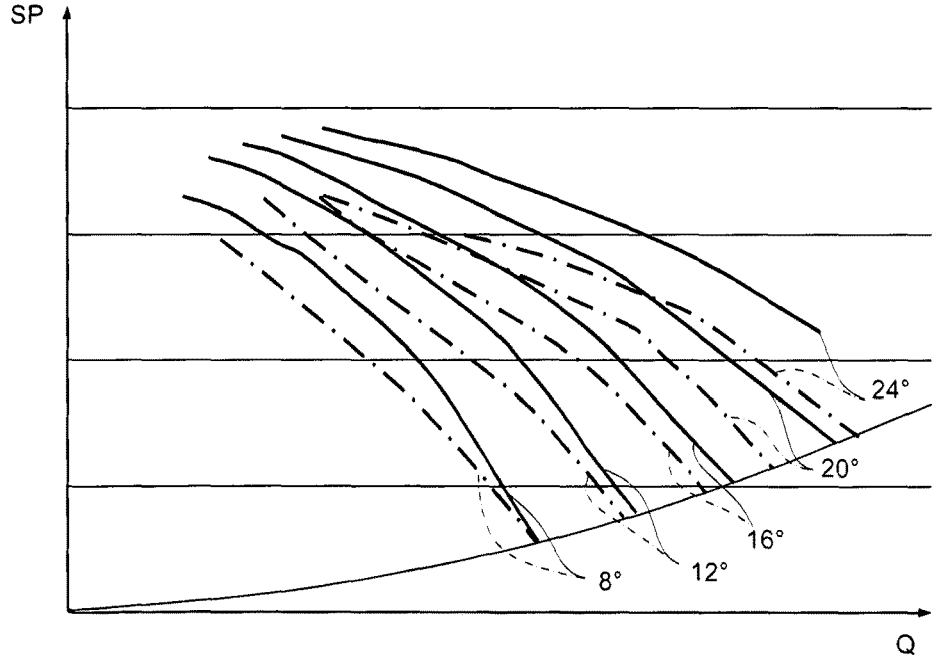

FIG. 7 shows the static pressure SP as a function of the flow rate, also in this case for different attack angles, for fans of equal diameter, chord and number of blades at the same rotation speed and air density.

As can be noted, practically in all conditions the working point corresponds to a lower pitch angle in the case of the axial fan 2. There is therefore greater margin compared to the stall conditions and greater pitch angles can be used. Comparable working conditions could be obtained with conventional fans only by increasing the number or size of the blades, and then with disadvantages in terms of costs and manufacture time.

Figure 8:
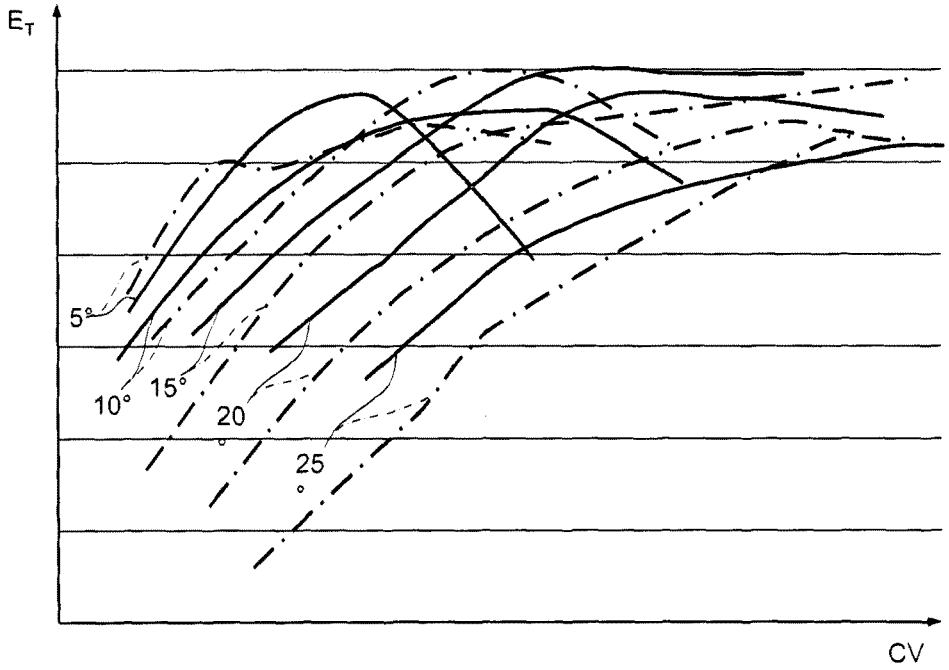

The graph of FIG. 8 shows the total efficiency of the fan as a function of the volumetric coefficient CV for different pitch angles.

The total efficiency is defined as:

$$E_T = \frac{Q \cdot TP}{W}$$

where TP is the total pressure, given, in turn, by the sum of the static pressure and the dynamic pressure, and W is the power absorbed by the fan.

Figure 9:
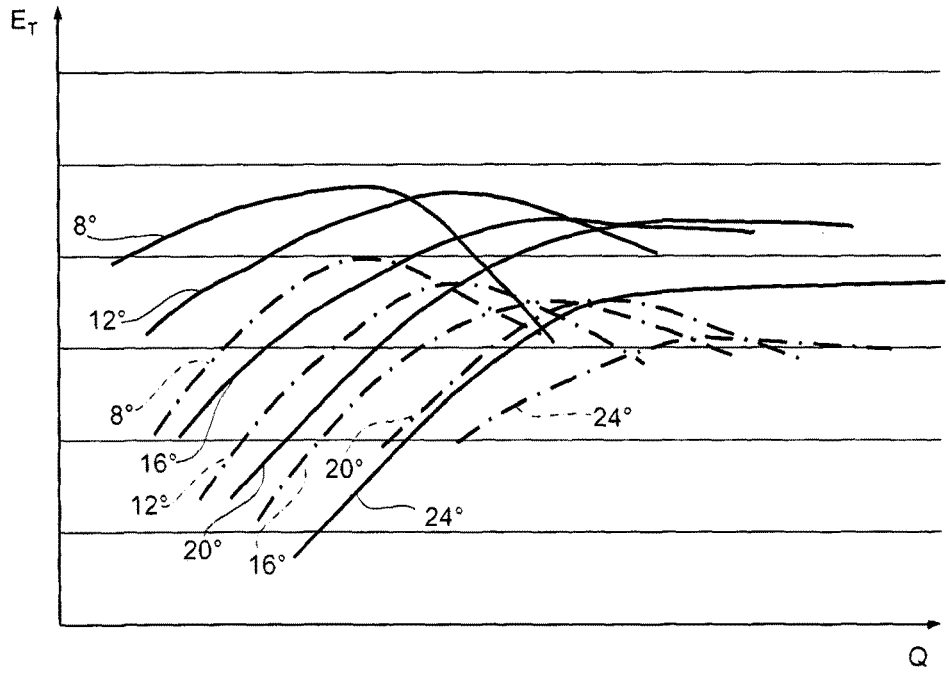

In FIG. 9, the total efficiency ET is expressed as a function of the flow rate Q for different attack angles. In this case, the power absorbed by the fans according to the invention and that absorbed by conventional fans capable of providing equal flow rate Q have been compared under the same static pressure SP. Given the greater flow rate Q ensured by the fan according to the invention with equal static pressure SP and equal dimensions, in practice, the graph of FIG. 9 was obtained by comparing fans of different sizes in terms of the chord and the number of blades (to obtain a given flow rate and static pressure is in fact necessary a conventional fan of larger size) having the same diameter, at the same rotational speed and air density.

Even in this case, the performance is best for the axial fan 2 according to the invention in almost all of the operating conditions.

Figure 10:
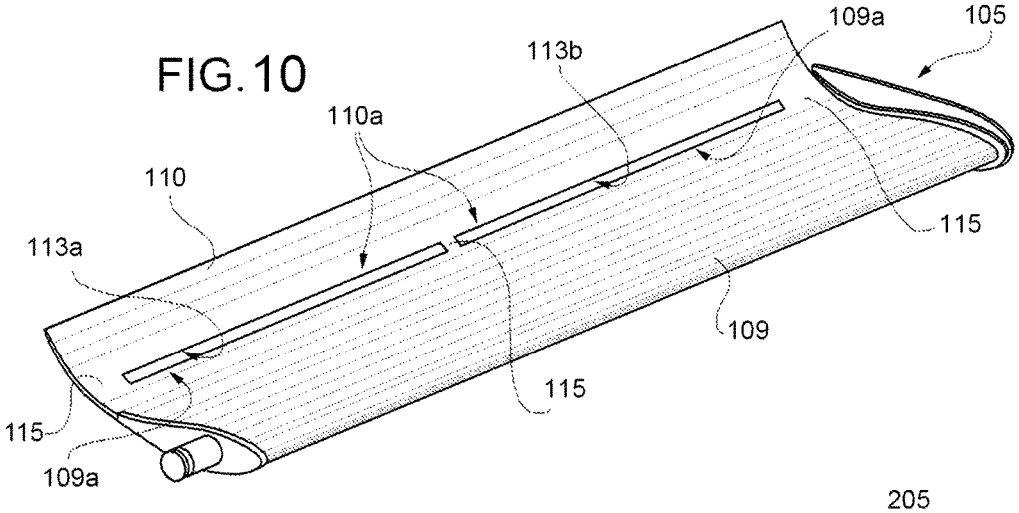
FIG. 10 is a perspective view of a blade of an axial fan according to a third embodiment of the invention.

According to a different embodiment of the invention, the axial fan 2 comprises a plurality of monolithic blades 105, one of which is illustrated in FIG. 10.

In this case, the blade 105 is formed by processing a single body. The blade 105 comprises a main blade portion 109 and a secondary blade portion 110, separated by a plurality of through openings 113*a*, 113*b* which extend along the longitudinal direction of the blade 105.

The main blade portion 109 precedes the secondary blade portion 110 in the rotation direction of the blade 105. The secondary blade portion 110 extends substantially parallel to the main blade portion 109 and forms a flap for the main blade portion 109 itself in areas corresponding to the through openings 113*a*, 113*b*.

The through openings 113*a*, 113*b* separate a trailing edge 109*a* of the main blade portion 109 forms a leading edge 110*a* of the secondary blade portion 110. More in detail, the through openings 113*a*, 113*b* extend in the longitudinal direction of the blade 105, substantially throughout the entire length thereof, and, in one embodiment, are mutually aligned and consecutive. The through openings 113*a*, 113*b* define a fluid passage which allows the passage of a fluid flow from the intrados of the main blade portion 109 to the extrados of the secondary blade portion 110. The dimensions of the main blade portion 109, of the secondary blade portion 110 and of the through openings 113*a*, 113*b* that define the fluid passage can be selected with the criteria described with reference to FIGS. 4 and 5.

The main blade portion 109 and the secondary blade portion 110 are connected to one another by connecting portions 115 at the ends of the blade 105 and between consecutive through openings.

In one embodiment, the aerodynamic profile of the secondary blade portion is defined by a bent metal sheet or composite material piece.

Figure 11:
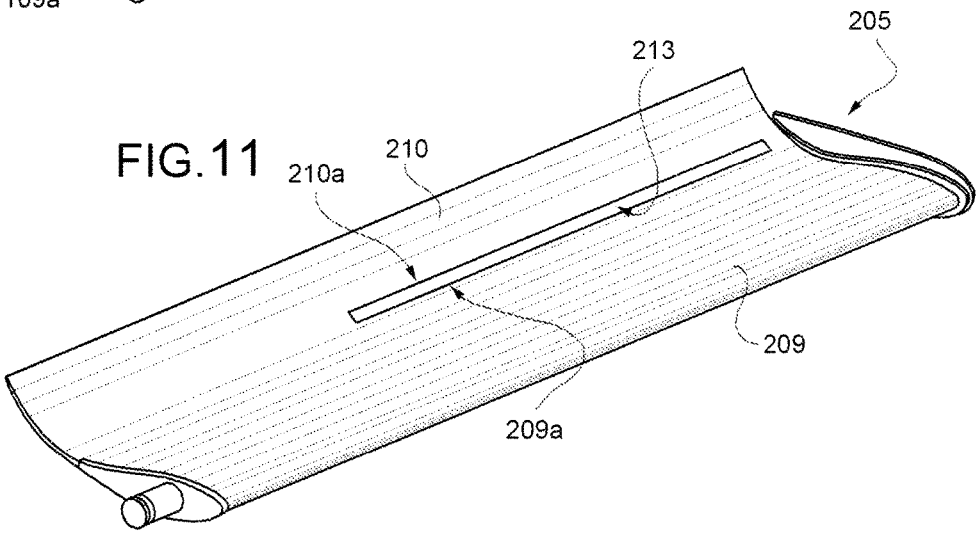
FIG. 11 is a perspective view of a blade of an axial fan according to a fourth embodiment of the invention.

According to a different embodiment, illustrated in FIG. 11, in one blade 205 of the axial fan a fluid passage is defined by one or more through openings 213 that separate a trailing edge 209*a* of a main blade portion 209 from a leading edge 210*a* of a secondary blade portion 209 only in a radially outer area of the blade 205. The secondary blade portion 210 forms a flap for the main blade portion 209 in an area corresponding to the fluid passage.

The radially inner portion of the blade 205, less critical for the lower tangential speed, is instead continuous.

Figure 12:
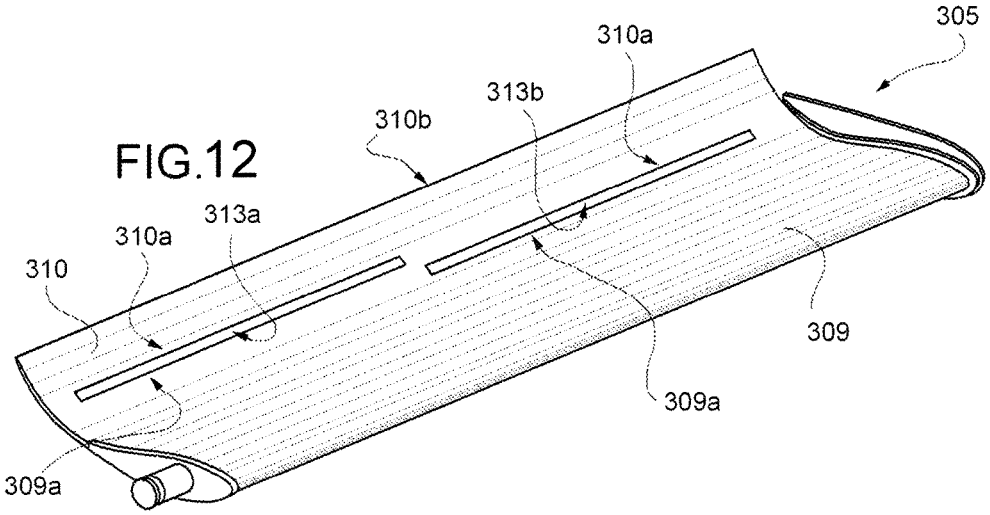
FIG. 12 is a perspective view of a blade of an axial fan according to a fifth embodiment of the invention.

In a further embodiment, illustrated in FIG. 12, a monolithic blade 305 comprises a main blade portion 309 and a secondary blade portion 310. Through openings 313*a*, 313*b* between a trailing edge 309*a* of the main blade portion 309 and a leading edge 310*a* of the secondary blade portion 310 define a fluid passage which allows the passage of a fluid flow from the intrados of the main blade portion 309 to the extrados of the secondary blade portion 310. The secondary blade portion 310 forms a flap for the main blade portion 309 in an area corresponding to the fluid passage.

In this case, the through openings 313*a*, 313*b* are not aligned. In particular, through openings 313*a* placed in a radially inner area of the blade 305 are closer to a trailing edge 310*b* of the secondary blade portion 310 than the through openings 313*b* which are arranged in a radially outer area.

Finally, it is evident that the axial fan described can be subject to modifications and variations, without departing from the scope of the present invention, as defined in the appended claims.

In particular, the diameter and the number of blades of the axial fan may vary from what is described.

The connection between the blades and the hub may differ from what is described. Among other things, the blades can be connected to the hub with a fixed pitch angle.

The invention claimed is:

1. An axial fan comprising a hub and a plurality of blades extending from the hub; wherein:

each blade comprises a main blade portion and a secondary blade portion, and the secondary blade portion has a leading edge adjacent to a trailing edge of the main blade portion and forms a flap for the main blade portion;

a fluid passage is defined between the trailing edge of the main blade portion and the leading edge of the secondary blade portion;

the main blade portion has a main chord and the secondary blade portion has a secondary chord; and wherein the main chord and the secondary chord form a relative attack angle between 5° and 35° and the blades are connected to the hub by respective bars, wherein in each blade:

the main blade portion is rigidly fixed to the respective bar;

the main blade portion and the secondary blade portion are connected together at respective ends by an outer end winglet and an inner end winglet, the outer end winglet and the inner end winglet are arranged crosswise to the main blade portion and to the secondary blade portion and extend tangentially with respect to the trajectory of the respective blade;

the outer end winglet and the inner end winglet are configured to reduce the vorticity of the flow at the ends of the respective blade.

2. The fan according to claim 1, wherein the leading edge of the secondary blade portion and the trailing edge of the main blade portion are separated by a first interblade distance, in a direction parallel to the main chord, and a ratio of the first interblade distance to the main chord is less than or equal to 0.2.

3. The fan according to claim 2, wherein the main blade portion and the secondary blade portion do not overlap in the direction of the main chord and the leading edge of the secondary blade portion is arranged downstream of the trailing edge of the main blade portion in the direction of the main chord.

4. The fan according to claim 2, wherein the main blade portion and the secondary blade portion overlap in the direction of the main chord and the leading edge of the secondary blade portion is arranged upstream of the trailing edge of the main blade portion in the direction of the main chord.

5. The fan according to claim 2, wherein the leading edge of the secondary blade portion and the trailing edge of the main blade portion are separated by a second interblade distance, in the direction perpendicular to the main chord, and a ratio between the second interblade distance and the main chord is lower than or equal to 0.2.

6. The fan according to claim 2, wherein the secondary chord is smaller than the main chord or equal to it.

7. The fan according to claim 6, wherein a ratio between the secondary chord and the main chord is comprised between 0.2 and 1.

8. The fan according to claim 2, wherein a ratio between a maximum thickness of the main blade portion and the main chord is comprised between 0.1 and 0.4.

9. The fan according to claim 1, wherein the fluid passage is configured so as to allow the passage of a fluid flow from an intrados of the main blade portion to an extrados of the secondary blade portion.

10. The fan according to claim 9, wherein the fluid passage is configured so that the fluid flow through the fluid passage is accelerated by Venturi effect.

11. The fan according to claim 1, wherein the fluid passage comprises a plurality of through openings extending in a longitudinal direction of the blade.

12. The fan according to claim 11, wherein the through openings are aligned and consecutive.

13. The fan according to claim 11, wherein at least one first through opening arranged in a radially inner area of the blade is closer to a trailing edge of the secondary blade portion than at least one second through opening arranged in a radially outer area of the blade.

14. The fan according to claim 1, wherein the fluid passage is formed solely in a radially outer area of the blade.

* * * * *